US011305532B2

(12) United States Patent
Hirai et al.

(10) Patent No.: US 11,305,532 B2
(45) Date of Patent: Apr. 19, 2022

(54) LIQUID EJECTION HEAD

(71) Applicant: Brother Kogyo Kabushiki Kaisha, Nagoya (JP)

(72) Inventors: Keita Hirai, Nagoya (JP); Shohei Koide, Nagoya (JP); Keita Sugiura, Toyokawa (JP); Hiroshi Katayama, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 2 days.

(21) Appl. No.: 16/835,531

(22) Filed: Mar. 31, 2020

(65) Prior Publication Data

US 2020/0307213 A1 Oct. 1, 2020

(30) Foreign Application Priority Data

Apr. 1, 2019 (JP) ..... JP2019-069606

(51) Int. Cl.
*B41J 2/14* (2006.01)

(52) U.S. Cl.
CPC .. *B41J 2/14201* (2013.01); *B41J 2002/14419* (2013.01)

(58) Field of Classification Search
CPC ..... B41J 2/14201; B41J 2002/14419; B41J 2002/14306; B41J 2202/12; B41J 2/14233
See application file for complete search history.

(56) References Cited

U.S. PATENT DOCUMENTS

2012/0160925 A1 6/2012 Hoisington et al.

FOREIGN PATENT DOCUMENTS

JP 2008-290292 A 12/2008
JP 2014-237323 A 12/2014

OTHER PUBLICATIONS

Machine Translation of JP 2008290292 A, "Liquid Droplet Ejecting Head and Image Forming Apparatus", Okuda, Shinichi, [Paragraphs 0029-0030, 0039-0054, 0068], Dec. 4, 2008 (Year: 2008).*
IP.com search (Year: 2021).*

* cited by examiner

*Primary Examiner* — Lisa Solomon
(74) *Attorney, Agent, or Firm* — Banner & Witcoff, Ltd.

(57) ABSTRACT

A liquid ejection head includes pressure chambers arrayed in an array direction, a supply manifold extending in the array direction, a return manifold disposed below the supply manifold, and a bypass channel. Each pressure chamber receives a pressure for ejecting liquid from a corresponding nozzle. The supply manifold communicates with the pressure chambers and includes a supply opening through which liquid enters from an exterior. The return manifold is formed by a first forming unit to extend in the array direction and communicate with the pressure chambers, and includes a return opening through which liquid exits to the exterior. The bypass channel connects the supply manifold and the return manifold. The first forming unit includes a first top surface defining a top surface of the return manifold, and a first protrusion protruding downward from the first top surface and having a lower end at which the bypass channel is open.

24 Claims, 8 Drawing Sheets

LIQUID EJECTION HEAD

CROSS-REFERENCE TO RELATED APPLICATION

This application claims priority from Japanese Patent Application No. 2019-069606 filed on Apr. 1, 2019, the content of which is incorporated herein by reference in its entirety.

TECHNICAL FIELD

Aspects of the disclosure relate to a liquid ejection head.

BACKGROUND

In a known liquid ejection head, ink supplied from an ink tank, via a supply tube, to a common supply main channel flows, through a common supply branch channel and a supply channel, into a pressure chamber. A part of the ink filled in the pressure chamber is ejected and the remaining ink is sequentially returned, through a discharge channel, a common discharge branch channel, a common discharge main channel, and a circulation tube, to the ink tank.

The common supply branch channel is stacked on the common discharge branch channel. An end of the common supply branch channel is connected to an end of the common discharge branch channel. This allows the ink, not having been supplied from the common supply branch channel to the supply channel, to flow from the common supply branch channel to the common discharge branch channel, merge with the ink discharged from the discharge channel, and flow into the common discharge main channel.

SUMMARY

In the known liquid ejection head, ink flows in the common supply branch channel in one direction and flows in the common discharge branch channel, which is located below the common supply branch channel, in the other direction opposite to the one direction. This may cause settling of ink components at a corner of the common discharge branch channel.

Aspects of the disclosure provide a liquid ejection head configured to reduce settling of liquid components.

According to one or more aspects of the disclosure, a liquid ejection head includes a plurality of pressure chambers arrayed in an array direction, a supply manifold extending in the array direction, a return manifold disposed below the supply manifold, and a bypass channel. Each pressure chamber is configured to receive an ejection pressure for ejecting liquid from a corresponding nozzle. The supply manifold communicates with the pressure chambers and includes a supply opening through which liquid enters from an exterior. The return manifold is formed by a first forming unit to extend in the array direction and communicate with the pressure chambers. The return manifold includes a return opening through which liquid exits to the exterior. The bypass channel connects the supply manifold and the return manifold. The first forming unit includes a first top surface defining a top surface of the return manifold, and a first protrusion protruding downward from the first top surface and having a lower end at which the bypass channel is open.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Illustrative embodiments of the disclosure will be described with reference to the drawings.

First Illustrative Embodiment

Structure of Liquid Ejection Apparatus

A liquid ejection apparatus 10 including a liquid ejection head 20 (hereinafter referred to as a "head") according to a first illustrative embodiment is configured to eject liquid. Hereinafter, the liquid ejection apparatus 10 will be described by way of example, as applied to, but not limited to, an inkjet printer.

Figure 1:
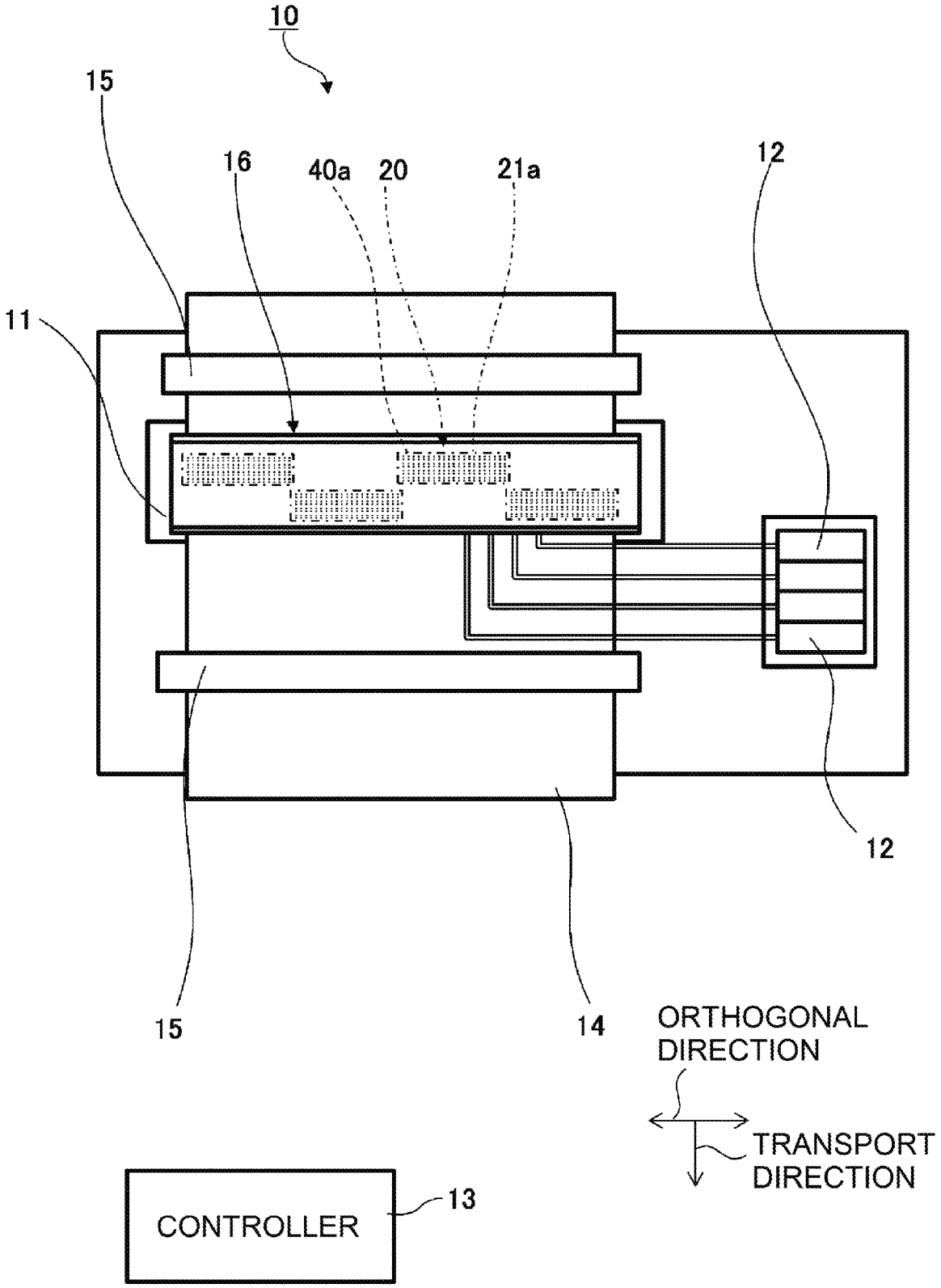
FIG. 1 is a schematic diagram of a liquid ejection apparatus including a liquid ejection head according to a first illustrative embodiment.

As shown in FIG. 1, the liquid ejection apparatus 10 employs a line head type and includes a platen 11, a transport unit, a head unit 16, tanks 12, and a controller 13. The liquid ejection apparatus 10 may employ a serial head type or other types than the line head type.

The platen 11 is a flat plate member to receive thereon a sheet 14 and adjust a distance between the sheet 14 and the head unit 16. Herein, one side of the platen 11 toward the head unit 16 is referred to as an upper side, and the other side of the platen 11 away from the head unit 16 is referred to as a lower side. However, the liquid ejection apparatus 10 may be positioned in other orientations.

The transport unit may include two transport rollers 15 and a transport motor (not shown). The two transport rollers 15 are disposed parallel to each other while interposing the platen 11 therebetween in a transport direction, and are connected to the transport motor. When the transport motor is driven, the transport rollers 15 rotate to transport the sheet 14 on the platen 11 in the transport direction.

The head unit 16 has a length greater than or equal to the length of the sheet 14 in a direction (an orthogonal direction)

orthogonal to the transport direction of the sheet 14. The head unit 16 includes a plurality of heads 20.

Each head 20 includes a stack structure including a channel unit and a volume changer. The channel unit includes liquid channels formed therein and a plurality of nozzle holes 21*a* open on a lower surface (an ejection surface 40*a*). The volume changer is driven to change the volume of a liquid channel. In this case, a meniscus in a nozzle hole 21*a* vibrates and liquid is ejected from the nozzle hole 21*a*. The head 20 will be described in detail later.

Separate tanks 12 are provided for different kinds of inks. For example, each of four tanks 12 stores therein a corresponding one of black, yellow, cyan, and magenta inks. Inks of the tanks 12 are supplied to corresponding nozzle holes 21*a*.

The controller 13 includes a processor such as a central processing unit (CPU), memories such as a random access memory (RAM) and a read only memory (ROM), and a driver such as an application specific integrated circuit (ASIC). In the controller 13, upon receipt of various requests and detection signals from sensors, the CPU causes the RAM to store various data and outputs various execution commands to the ASIC based on programs stored in the ROM. The ASIC controls driver ICs based on the commands to execute required operation. The transport motor and the volume changer are thereby driven.

Specifically, the controller 13 executes ejection from the head unit 16, and transport of sheets 14. The head unit 16 is controlled to eject ink from the nozzle holes 21*a*. A sheet 14 is transported in the transport direction intermittently by a predetermined amount. Printing progresses by execution of ink ejection and sheet transport.

Structure of Head

Figure 2:
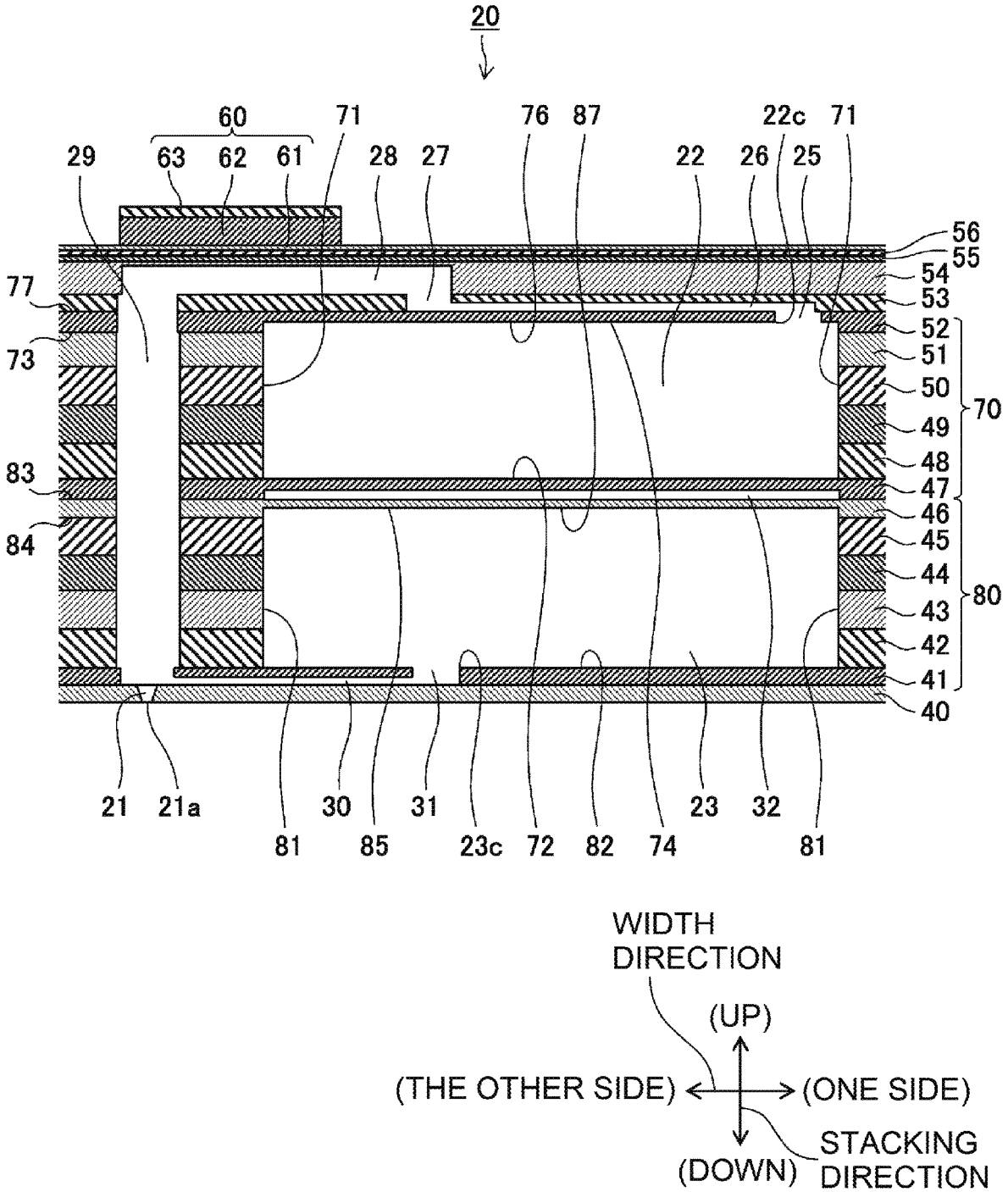
FIG. 2 is a cross-sectional view of the liquid ejection head of FIG. 1 taken along a line orthogonal to an array direction.
Figure 3:
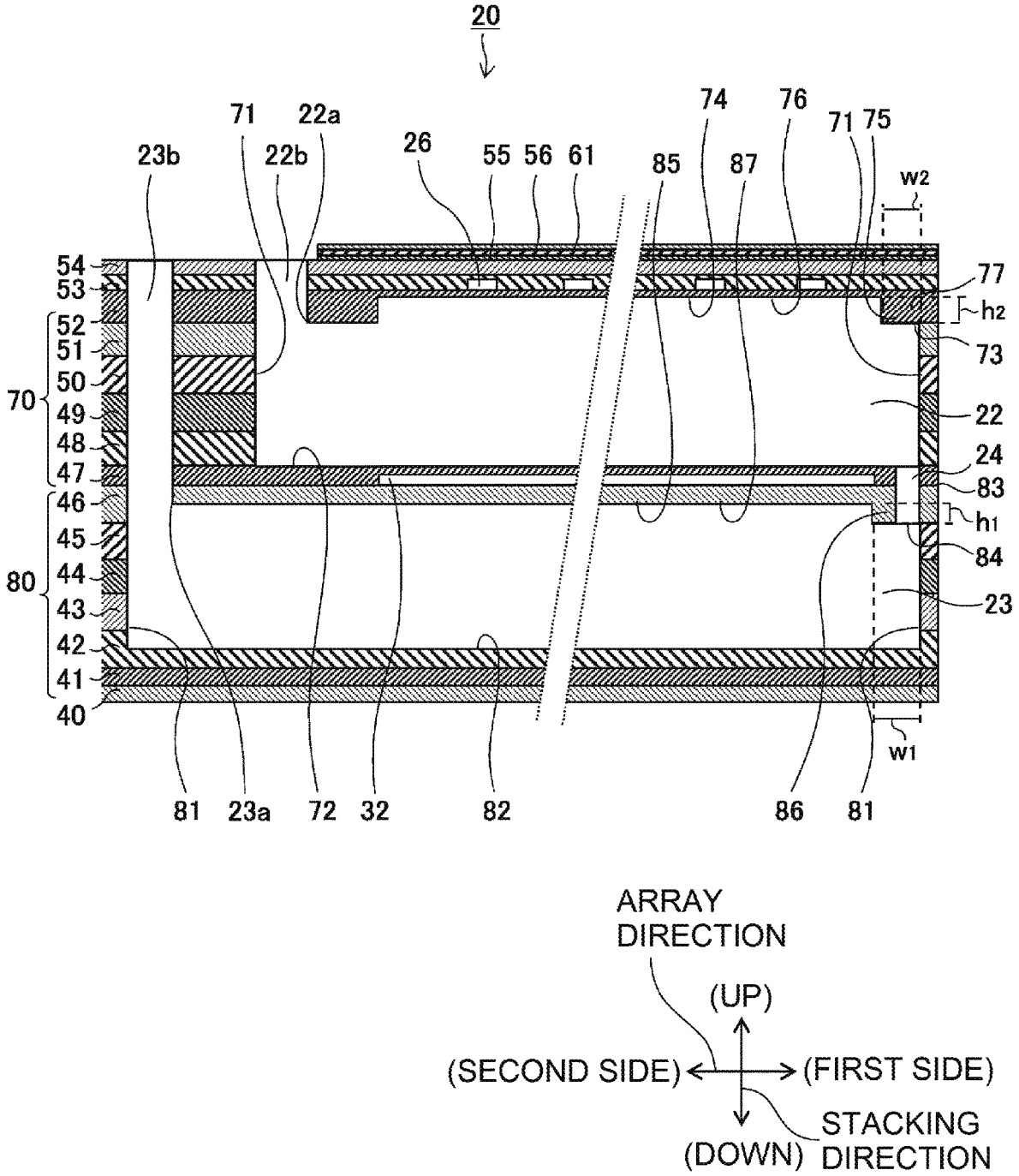
FIG. 3 is a cross-sectional view of the liquid ejection head of FIG. 1 taken along a line orthogonal to a width direction of the liquid ejection head.
Figure 4:
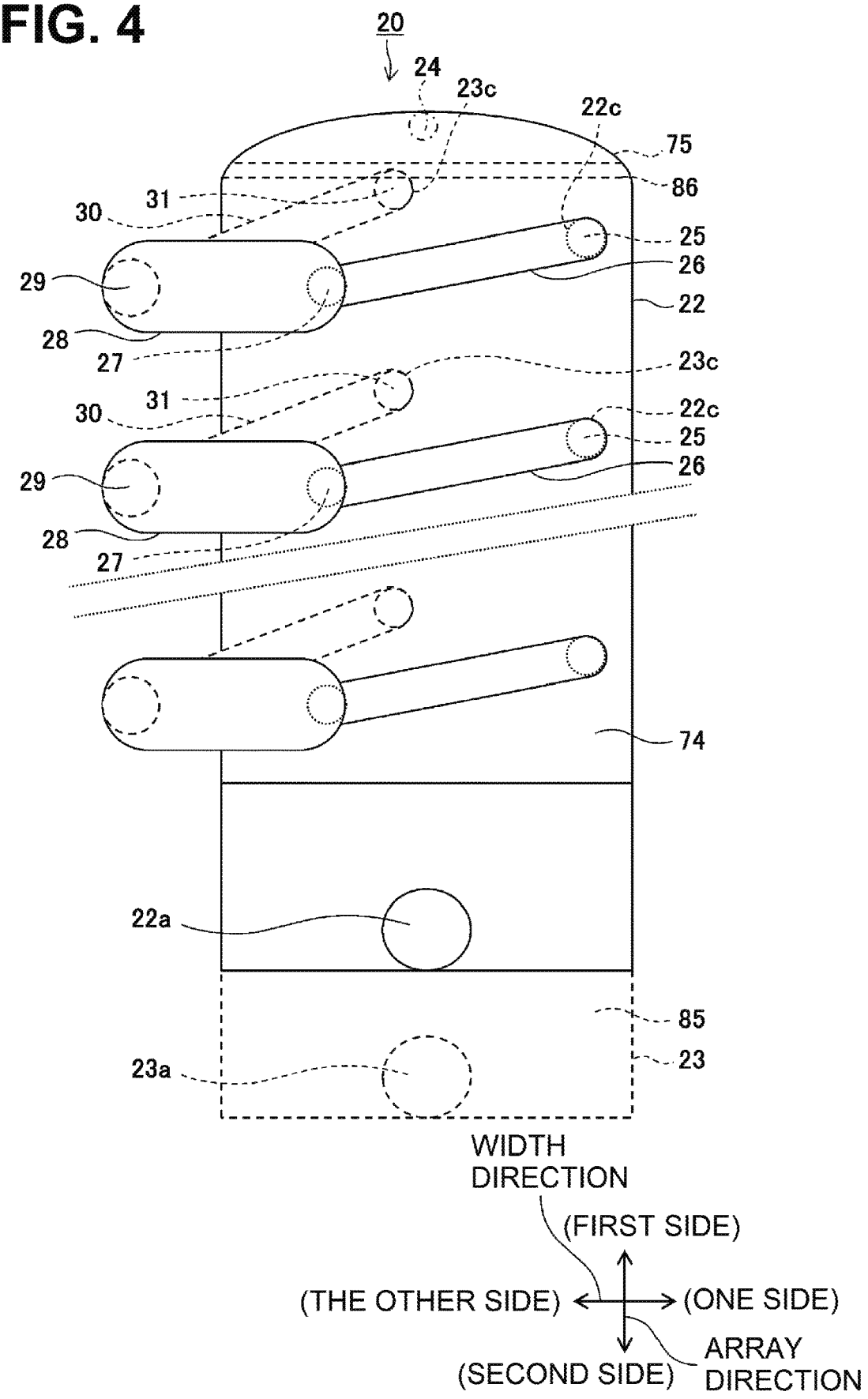
FIG. 4 is a top view of the liquid ejection head of FIG. 1 in a stacking direction, showing a positional relation of manifolds, throttle channels, communication holes, and a pressure chamber.

As described above, each head 20 includes the channel unit and the volume changer. As shown in FIGS. 2 through 4, the channel unit is formed by a stack of a plurality of plates, and the volume changer includes a vibration plate 55 and piezoelectric elements 60.

The plurality of plates include a nozzle plate 40, a first channel plate 41, a second channel plate 42, a third channel plate 43, a fourth channel plate 44, a fifth channel plate 45, a sixth channel plate 46, a seventh channel plate 47, an eighth channel plate 48, a ninth channel plate 49, a 10th channel plate 50, an 11th channel plate 51, a 12th channel plate 52, a 13th channel 53, and a 14th channel plate 54. These plates are stacked in this order in a stacking direction.

Each plate has holes and grooves of various sizes formed by etching. A combination of holes and grooves in the stacked plates of the channel unit define liquid channels such as a plurality of nozzles 21, a plurality of individual channels, a supply manifold 22, and a return manifold 23. The supply manifold 22 and the return manifold 23 are connected by a bypass channel 24. The supply manifold 22, the return manifold 23, and the bypass channel 24 will be described in detail later.

The nozzles 21 are formed to penetrate the nozzle plate 40 in the stacking direction. Ends of nozzles 21 (nozzle holes 21*a*) are arranged, as a nozzle array, in an array direction on the ejection surface 40*a* of the nozzle plate 40.

The array direction is orthogonal to the stacking direction and may be parallel or inclined relative to the orthogonal direction shown in FIG. 1. One side in the array direction is referred to as a first side, and the other side in the array direction is referred to as a second side. A direction orthogonal to the array direction and to the stacking direction are referred to as a width direction.

The plurality of individual channels are connected to the supply manifold 22 and to the return manifold 23. Each individual channel is connected, at its upstream end, to the supply manifold 22, connected, at its downstream end, to the return manifold 23, and connected, at its midstream, to a base end of a corresponding nozzle 21. Each individual channel includes a first communication hole 25, a supply throttle channel 26, a second communication hole 27, a pressure chamber 28, a descender 29, a return throttle channel 30, and a third communication hole 31, which are fluidly connected in this order.

The first communication hole 25 is connected, at its lower end, to a second opening 22*c* of a second top surface of the supply manifold 22 and extends upward from the supply manifold 22 in the stacking direction to penetrate an upper portion of the 12th channel plate 52 in the stacking direction. The first communication hole 25 is offset to one side from a center of the supply manifold 22 in the width direction. The cross-sectional area defined by the first communication hole 25 to be orthogonal to the stacking direction is less than the cross-sectional area defined by the supply manifold 22 to be orthogonal to the array direction.

The supply throttle channel 26 is connected, at its one end, to an upper end of the first communication hole 25, and extends obliquely toward the other side in the width direction and toward the second side in the array direction. The supply throttle channel 26 is formed by a groove recessed from a lower surface of the 13th channel plate 53. The cross-sectional area defined by the supply throttle channel 26 to be orthogonal to an extending direction of the supply throttle channel 26 is less than the cross-sectional area defined by the first communication hole 25 to be orthogonal to the stacking direction.

The second communication hole 27 is connected, at its lower end, to the other end of the supply throttle channel 26, and extends from the supply throttle channel 26 upward in the stacking direction to penetrate an upper portion of the 13th channel plate 53 in the stacking direction. The second communication hole 27 is offset to the other side from the center of the supply manifold 22 in the width direction. The cross-sectional area defined by the second communication hole 27 to be orthogonal to the stacking direction is greater than the cross-sectional area defined by the supply throttle channel 26 to be orthogonal to the width direction.

The pressure chamber 28 is connected, at its one end, to an upper end of the second communication hole 27, and extends in the width direction. The pressure chamber 28 penetrates the 14th channel plate 54 in the stacking direction. The cross-sectional area defined by the pressure chamber 28 to be orthogonal to the width direction is greater than the cross-sectional area defined by the second communication hole 27 to be orthogonal to the stacking direction.

The descender 29 penetrates the first through 13th plate channels 41-53 in the stacking direction and is located further to the other side in the width direction than the supply manifold 22 and the return manifold 23. The descender 29 is connected, at its upper end, to the other end of the pressure chamber 28, and is connected, at its lower end, to the nozzle 21. For example, the nozzle 21 is located to overlap the descender 29 in the stacking direction and is located at a center of the descender 29 in a direction orthogonal to the stacking direction.

The descender 29 may have a cross-sectional area which is uniform or varies in the stacking direction. For example, an upper portion (defined by the 12th plate channel 52 and the 13th plate channel 53) of the descender 29 may have a cross-sectional area which decreases toward the upper end.

The return throttle channel 30 is connected, at its one end, to a lower end of the descender 29 and extends from the descender 29 obliquely toward the one side in the width direction and toward the first side in the array direction. The return throttle channel 30 is formed by a groove recessed from a lower surface of the first channel plate 41. The cross-sectional area defined by the return throttle channel 30 to be orthogonal to an extending direction of the return throttle channel 30 is less than the cross-sectional area defined by the descender 29 to be orthogonal to the stacking direction.

The third communication hole 31 is connected, at its lower end, to the other end of the return throttle channel 30, and extends from the return throttle channel 30 upward in the stacking direction to penetrate an upper portion of the first channel plate 41 in the stacking direction. The third communication hole 31 is connected, at its upper end, to a first opening 23*c* of a first bottom surface of the return manifold 23. The third communication hole 31 is offset to the other side from a center of the return manifold 23 in the width direction, and is located further to the first side in the array direction than the descender 29, the first communication hole 25, and the second communication hole 27. The cross-sectional area defined by the third communication hole 31 to be orthogonal to the stacking direction is greater than the cross-sectional area defined by the return throttle channel 30.

The vibration plate 55 is stacked on the 14th channel plate 54 to cover upper openings of the pressure chambers 28. The vibration plate 55 may be integral with the 14th channel plate 54. In this case, each pressure chamber 28 is formed recessed from a lower surface of the 14th channel plate 54. An upper portion of the 14th channel plate 54, which is above each pressure chamber 28, functions as the vibration plate 55.

Each piezoelectric element 60 includes a common electrode 61, a piezoelectric layer 62, and an individual electrode 63 which are arranged in this order. The common electrode 61 entirely covers the vibration plate 55 via the insulating film 56. Each piezoelectric layer 62 is located on the common electrode 61 to overlap a corresponding pressure chamber 28. Each individual electrode 63 is provided for a corresponding pressure chamber 28 and is located on a corresponding piezoelectric layer 62. In this case, a piezoelectric element 60 is formed by an active portion of a piezoelectric layer 62, which is sandwiched by an individual electrode 63 and the common electrode 61.

Each individual electrode 63 is electrically connected to a driver IC. The driver IC receives control signals from the controller 13 (FIG. 1) and generates drive signals (voltage signals) selectively to the individual electrodes 63. In contrast, the common electrode 61 is constantly maintained at a ground potential.

In response to a drive signal, an active portion of each selected piezoelectric layer 62 expands and contracts in a surface direction, together with the two electrodes 61 and 63. Accordingly, the vibration plate 55 corporates to deform to increase and decrease the volume of a corresponding pressure chamber 28. This applies a pressure to the corresponding pressure chamber 28 which in turn ejects liquid from a nozzle 21.

Structures of Supply Manifold, Return Manifold, and Bypass Channel

The supply manifold 22 and the return manifold 23 extend long in the array direction and are connected to the individual channels. The supply manifold 22 is stacked on the return manifold 23. The supply manifold 22 and the return manifold 23 overlap each other in the stacking direction. This may downsize the liquid ejection head 20 in a direction orthogonal to the stacking direction.

The cross-sectional area defined by the supply manifold 22 to be orthogonal to the array direction is equal to the cross-sectional area defined by the return manifold 23 to be orthogonal to the array direction. For example, the supply manifold 22 and the return manifold 23 may be the same in size and shape. In this case, the supply manifold 22 and the return manifold 23 may have the same dimensions in the width direction and in the stacking direction.

The supply manifold 22 is formed by through-holes penetrating in the stacking direction the eighth channel plate 48 through the 11th channel plate 51, and a recess recessed from a lower surface of the 12th channel plate 52. The recess overlaps the through-holes in the stacking direction. A lower end of the supply manifold 22 is covered by the seventh channel plate 47, and an upper end of the supply manifold 22 is covered by an upper portion of the 12th channel plate 52.

The seventh channel plate 47 through the 12th channel plate 52 serve as a second forming unit to form the supply manifold 22. Out of these channel plates, the eighth channel plate 48 through the 12th channel plate 52 define second side surfaces 71. The second side surfaces 71 define side surfaces of the supply manifold 22, which may be parallel to the stacking direction.

The seventh channel plate 47 includes a pair of surfaces crossing (e.g., orthogonal to) the stacking direction. An upper one of the pair of surfaces is a second bottom surface 72. The second bottom surface 72 covers, as a bottom surface of the supply manifold 22, a lower end of the supply manifold 22.

The 12th channel plate 52, as a second top surface plate, includes a pair of surfaces crossing (e.g., orthogonal to) the stacking direction. An upper one of the pair of surfaces is a second upper surface 77, and a lower one of the pair of surfaces is a second lower surface 73. The second lower surface 73 covers, as a top surface of the supply manifold 22, an upper end of the supply manifold 22.

The 12th channel plate 52 includes a second recess 74 and a second protrusion 75. The second recess 74 and the second protrusion 75 extends in the width direction along the entire length of the supply manifold 22.

The second recess 74 is recessed upward from the second lower surface 73 to the second top surface 76, and extends in the array direction. In the array direction, a first-side end of the second recess 74 is located further to the second side than the second side surface 71 on the first side, and a second-side end of the second recess 74 is located further to the first side than the second side surface 71 on the second side. The lower surface 73 and the second top surface 76 cover an upper end of the supply manifold 22, thereby defining a top surface of the supply manifold 22.

The second protrusion 75 is located between the second recess 74 and the second side surface 71 on the first side, and is formed by a step between the second lower surface 73 and the second top surface 76. The second lower surface 73 is below the second top surface 76 which may be parallel to the second lower surface 73. Thus, the second protrusion 75 protrudes downward from the second top surface 76 to the second lower surface 73. The second protrusion 75 is located at an upper corner, of the supply manifold 22, on the first side in the array direction, and protrude from the second side surface 71 on the first side toward the second side.

The supply manifold 22 includes a supply opening 22*a*. The supply opening 22*a* is located in the top surface of the supply manifold 22 at a second-side end in the array direction and at a center in the width direction. The supply opening 22*a* is connected to a supply passage 22*b*. The supply passage 22*b* extends upward from the supply opening 22*a* to penetrate the 12th channel plate 52 through the 14th channel plate 54.

The return manifold 23 is formed by through-holes penetrating in the stacking direction the second channel plate 42 through the fifth channel plate 45, and a recess recessed from a lower surface of the sixth channel plate 46. The recess overlaps the through-holes in the stacking direction. A lower end of the return manifold 23 is covered by the first channel plate 41, and an upper end of the return manifold 23 is covered by an upper portion of the sixth channel plate 46.

The first channel plate 41 through the sixth channel plate 46 serve as a first forming unit to form the return manifold 23. Out of these channel plates, the second channel plate 42 through the sixth channel plate 46 define first side surfaces 81. The first side surfaces 81 define side surfaces of the return manifold 23, which may be parallel to the stacking direction.

The first channel plate 41 includes a pair of surfaces crossing (e.g., orthogonal to) the stacking direction. An upper one of the pair of surfaces is a first bottom surface 82. The second bottom surface 82 covers, as a bottom surface of the return manifold 23, a lower end of the return manifold 23.

The sixth channel plate 46, as a first top surface plate, includes a pair of surfaces crossing (e.g., orthogonal to) the stacking direction. An upper one of the pair of surfaces is a first upper surface 83, and a lower one of the pair of surfaces is a first lower surface 84.

The sixth channel plate 46 includes a first recess 85 and a first protrusion 86. The first recess 85 and the first protrusion 86 extend in the width direction along the entire length of the supply manifold 22.

The first recess 85 is recessed upward from the first lower surface 84 to the first top surface 87. In the array direction, a first-side end of the first recess 85 is located further to the second side than the first side surface 81 on the first side, and a second-side end of the first recess 85 is located at first side surface 81 on the second side. The lower surface 84 and the first top surface 87 cover an upper end of the return manifold 23, defining a top surface of the return manifold 23.

The first protrusion 86 is located between the first recess 85 and the first side surface 81 on the first side, and is formed by a step between the first lower surface 84 and the first top surface 87. The first lower surface 84 is below the first top surface 87 which may be parallel to the first lower surface 84. Thus, the first protrusion 86 protrudes downward from the first top surface 87 to the first lower surface 84 which is a lower end of the first protrusion 86.

The first protrusion 86 is located at an upper corner on the first side in the array direction of the return manifold 23, and protrudes from the first side surface 81 on the first side toward the second side. The first protrusion 86 is located below the second protrusion 75 to overlap the second protrusion 75 in the stacking direction.

The return manifold 23 includes a return opening 23*a*. The return opening 23*a* is located in the top surface of the return manifold 23 at a second-side end in the array direction and a center in the width direction. The return opening 23*a* is connected to a return passage 23*b*. The return passage 23*b* extends upward from the return opening 23*a* to penetrate the sixth channel plate 46 through the 14th channel plate 54.

The return manifold 23 is longer than the supply manifold 22 in the array direction, and first-side ends of these manifolds 22 and 23 overlap each other in the stacking direction. The return opening 23*a* is located further to the second side than the supply opening 22*a*.

In the array direction, the first recess 85 is longer than the second recess 74, and extends between the first protrusion 86 and the return opening 23*a*. A dimension w1 of the first protrusion 86 is greater than a dimension w2 of the second protrusion 75. In the stacking direction, the first recess 85 is shallower than the second recess 74, and a protruding dimension h1 of the first protrusion 86 is less than a protruding dimension h2 of the second protrusion 75.

The bypass channel 24 is connected, at its upper end, to the supply manifold 22 and, at its lower end, to the return manifold 23. The bypass channel 24 extends in the stacking direction to penetrate the sixth channel plate 46 and the seventh channel plate 47. In the stacking direction, the length of the bypass channel 24 is equal to the sum of the length (plate thickness) of the sixth channel plate 46 and the length (plate thickness) of the seventh channel plate 47.

The bypass channel 24 is located at a center in the width direction of the supply manifold 22 and the return manifold 23. The cross-sectional area defined by the bypass channel 24 to be orthogonal to the stacking direction is less than the cross-sectional area defined by each of the supply manifold 22 and the return manifold 23 to be orthogonal to the array direction.

An upper end of the bypass channel 24 is open on the second bottom surface 72. This upper opening is located, in the supply manifold 22, further to the first side than the first communication hole 25. For example, this upper opening is located at a corner between the second bottom surface 72 and the second side surface 71 on the first side. This upper opening faces the second protrusion 75.

The bypass channel 24 penetrates the first protrusion 86 and a lower end of the bypass channel 24 is open on the first lower surface 84. A dimension of this lower opening in the array direction is less than the dimension w1 of the first protrusion 86. The lower opening of the bypass channel 24 is located, in the return manifold 23, further to the first side than the third communication hole 31. For example, the lower opening is located at a corner between the first lower surface 84 and the first side surface 81 on the first side.

The supply manifold 22 and the return manifold 23 define a buffer space 32 therebetween. The buffer space 32 is formed, at a position further to the second side than the bypass channel 24, by a recess recessed from a lower surface of the seventh channel plate 47. In the stacking direction, the supply manifold 22 and the buffer space 32 are adjacent to each other via an upper portion of the seventh channel plate 47, and the return manifold 23 and the buffer space 32 are adjacent to each other via the upper portion of the sixth channel plate 46.

The supply manifold 22 and the return manifold 23 define a buffer space 32 therebetween. The buffer space 23 may reduce interaction between the liquid pressure in the supply manifold 22 and the liquid pressure in the return manifold 23.

Liquid Flow

By way of example, a subtank is connected to the supply passage 22*b* via a supply conduit and connected to the return passage 23*b* via a return conduit. A subtank, which may be disposed above a head 20, is connected to a tank 12 to receive liquid supplied from the tank 12.

A pressure pump disposed in the supply conduit, and a negative-pressure pump disposed in the return conduit are driven. Liquid flows from the subtank in the supply conduit and from the supply passage 22*b*, via the supply opening 22*a*, into the supply manifold 22 where liquid flows in the array direction.

Meanwhile, liquid partially flows into the individual channels. In each individual channel, liquid flows from the supply manifold 22, via the first communication hole 25, into the supply throttle channel 26 where liquid flows in the width direction. Liquid further flows from the supply throttle channel 26, via the second communication hole 27, into the pressure chamber 28 where liquid flows in the width direction. Then, liquid flows from an upper end to a lower end of the descender 29 in the stacking direction to enter the nozzle 21. When the piezoelectric element 60 applies an ejection pressure to the pressure chamber 28, liquid is ejected from a nozzle hole 21*a*.

Liquid having not been ejected flows in the return throttle channel 30 in the width direction and flows, via the third communication hole 31, into the return manifold 23. The liquid flows in the return manifold 23 in the array direction.

The liquid not having flown into the individual channels flows in the supply manifold 22 from the second side toward the first side into the bypass channel 24, and further flows from the bypass channel 24 into the return manifold 23. When liquid passes past the bypass channel 24 and flows in the return manifold 23 from the first side toward the second side, the liquid merges with the liquid having not been ejected from the individual channels and flowing into the return manifold 23. Then, the liquid is discharged from the return opening 23*a*, via the return passage 23*b*, and returns in the return conduit to the subtank. Thus, liquid having not been ejected from the nozzles 21*a* circulates between the subtank and the individual channels, and between the subtank and the bypass channel 24.

Effects

The above-described head 20 includes the supply manifold 22, the return manifold 23, and the bypass channel 24. The supply manifold 22 extends in the array direction, communicates with the pressure chambers 28, and includes the supply opening 22*a* through which liquid enters from an exterior. The return manifold 23 is disposed below the supply manifold 22, extends in the array direction, communicates with the pressure chambers 28, and includes the return opening 23*a* through which liquid exits to the exterior. The return manifold 23 is formed by the first forming unit 80. The bypass channel 24 connects the supply manifold 22 and the return manifold 23. The first forming unit 80 includes the first top surface 87 defining the top surface of the return manifold 23, and the first protrusion 86 which protrudes downward from the first top surface 87 and at a lower end of which the bypass channel 24 is open.

This structure allows liquid to flow from the lower-end opening of the bypass channel 24 into the return manifold 23. The lower-end opening is located at a lower end (the first lower surface 84) of the first protrusion 86. The first protrusion 86 decreases the cross-sectional area of the return manifold 23, thereby increasing the flow velocity at a portion facing the lower-end opening. This may disperse the liquid and reduce settling of liquid components in the return manifold 23 where components of liquid flowing from the bypass channel 24 are otherwise likely to settle.

In the above-described head 20, the first forming unit 80 includes the first top surface plate (the sixth channel plate 46). The first top surface plate includes the first upper surface 83, the first lower surface 84 opposite to the first upper surface 83, the first recess 85 recessed upward from the first lower surface 84 to the first top surface 87, and the first protrusion 86 formed as a step between the first lower surface 84 and the first top surface 87.

The first recess 85 increases the cross-sectional area of the return manifold 23, thereby reducing pressure loss of the liquid flowing there. The first recess 85 defines, in the single first top surface plate, the first top surface 87 and the first protrusion 86. This may not cause an increase in number of components and cost.

In the above-described head 20, the bypass channel 24 penetrates a portion of the first top surface plate, the portion being between the first upper surface 83 and the first lower surface 84.

Unlike this embodiment, if the first recess 85 is formed by etching, and the bypass channel 83 is formed to penetrate the first top surface 87 of the first recess 85 and the first upper surface 83, the bypass channel 24 varies in length. This is because it is hard to adjust the depth of the first recess 85 by etching, causing variations in dimension between the first top surface 87 and the first upper surface 83. A flow resistance in the bypass channel 24 depends on the length of the bypass channel 24 and thus fluctuates.

In contrast, in this embodiment, a dimension between the first upper surface 83 and the first lower surface 84 corresponds to the plate thickness of the first top surface plate. The length of the bypass channel 24 is made uniform, enabling uniform adjustment of pressure loss of the liquid flowing in the bypass channel 24.

In the above-described head 20, the first recess 85 extends between the first protrusion 86 and the return opening 23*a*. In the return manifold 23, there are no other protrusions between the first protrusion 86 and the return opening 23*a*. Thus, air bubbles enter through the lower-end opening of the bypass channel 24 on the first lower surface 84 of the first protrusion 86 and move from the first lower surface 84, along the first top surface 87 of the first recess 85, toward the return opening 23*a*. In this case, air bubbles are likely to be discharged from the return opening 23*a* without being blocked by any protrusion.

In the above-described head 20, the first forming unit 80 includes the first bottom surface 82 facing the first top surface 87. The head 20 includes a throttle channel (the return throttle channel 30) which communicates with the corresponding pressure chamber 28 and the return manifold 23, is open on the first bottom surface 82, and has a cross-sectional area smaller than that of the pressure chamber 28.

In this structure, liquid having flown from the supply manifold 22 into the individual channel and having not been ejected from the nozzle 21 passes in the return throttle channel 30 and flows, via the third communication hole 31, into the return manifold 23. In this case, the liquid entering via the third communication hole 31, which is formed in the first bottom surface 82, disperses liquid components settled on the first bottom surface. This may reduce settling of liquid components.

In the above-described head 20, the second forming unit 70, which defines the supply manifold 22, includes the second bottom surface 72, the second top surface 76, and the second protrusion 75. The second bottom surface 72 defines a bottom surface of the supply manifold 22, and the bypass channel 24 is open on the bottom surface. The second top surface 76 faces the second bottom surface 72. The second protrusion 75 faces an upper-end opening of the bypass channel 24 and protrudes downward from the second top surface 76.

The second protrusion 75 decreases the cross-sectional area of the supply manifold 22, thereby increasing the flow velocity at a portion facing the upper-end opening of the bypass channel 24. This increases the flow velocity of the liquid passing this portion to flow, through the upper-end opening, into the bypass channel 24. The liquid flow at a high velocity enters the return manifold 23 from the bypass channel 24, thereby dispersing liquid components to prevent their settling and pushing away and discharging air bubbles.

In the above-described head 20, the protruding dimension h1 of the first protrusion 86 is less than the protruding dimension h2 of the second protrusion 75. The first protrusion 86, which is relatively low, makes the first recess 85 shallow. Unlike this embodiment, if the first recess 85 is deep, air bubbles are likely to be trapped at corners of the first recess. In contrast, in this embodiment, air bubbles are less likely to be trapped in the shallow first recess 85. Thus, air bubbles are likely to be discharged from the return manifold 23.

The second protrusion 75, which is relatively high, makes the second recess 74 deep. Air bubbles are likely to be trapped at the second recess 74 in the supply manifold 22. The second recess 74 traps air bubbles to reduce the amount of air bubbles entrained downstream of the second recess 74. This may reduce entraining of air bubbles into the downstream nozzle 21 and ejection failure due to air bubbles.

In the above-described head 20, in the array direction, the dimension w1 of the first protrusion 86 is greater than the dimension w2 of the second protrusion 75. The first protrusion 86 decreases the cross-sectional area in a larger zone of the return manifold 23, and thus the flow velocity is high in the larger zone where settling of liquid components may be reduced.

In the above-described head 20, the second forming unit 70 includes the second top surface plate (the 12th channel plate 52). The second top surface plate includes the second upper surface 77, the second lower surface 73 opposite to the second upper surface 77, the second recess 74, and the second protrusion 75. The second recess 74 is recessed upward from the second lower surface 73 to the second top surface 76. The second protrusion 75 is formed by a step between the second lower surface 73 and the second top surface 76.

The second recess 74 increases the cross-sectional area of the supply manifold 22, thereby reducing pressure loss of the liquid flowing there. The second recess 74 defines, in the single second top surface plate, the second top surface 76 and the second protrusion 75. This may not cause an increase in number of components and cost.

First Modification

Figure 5:
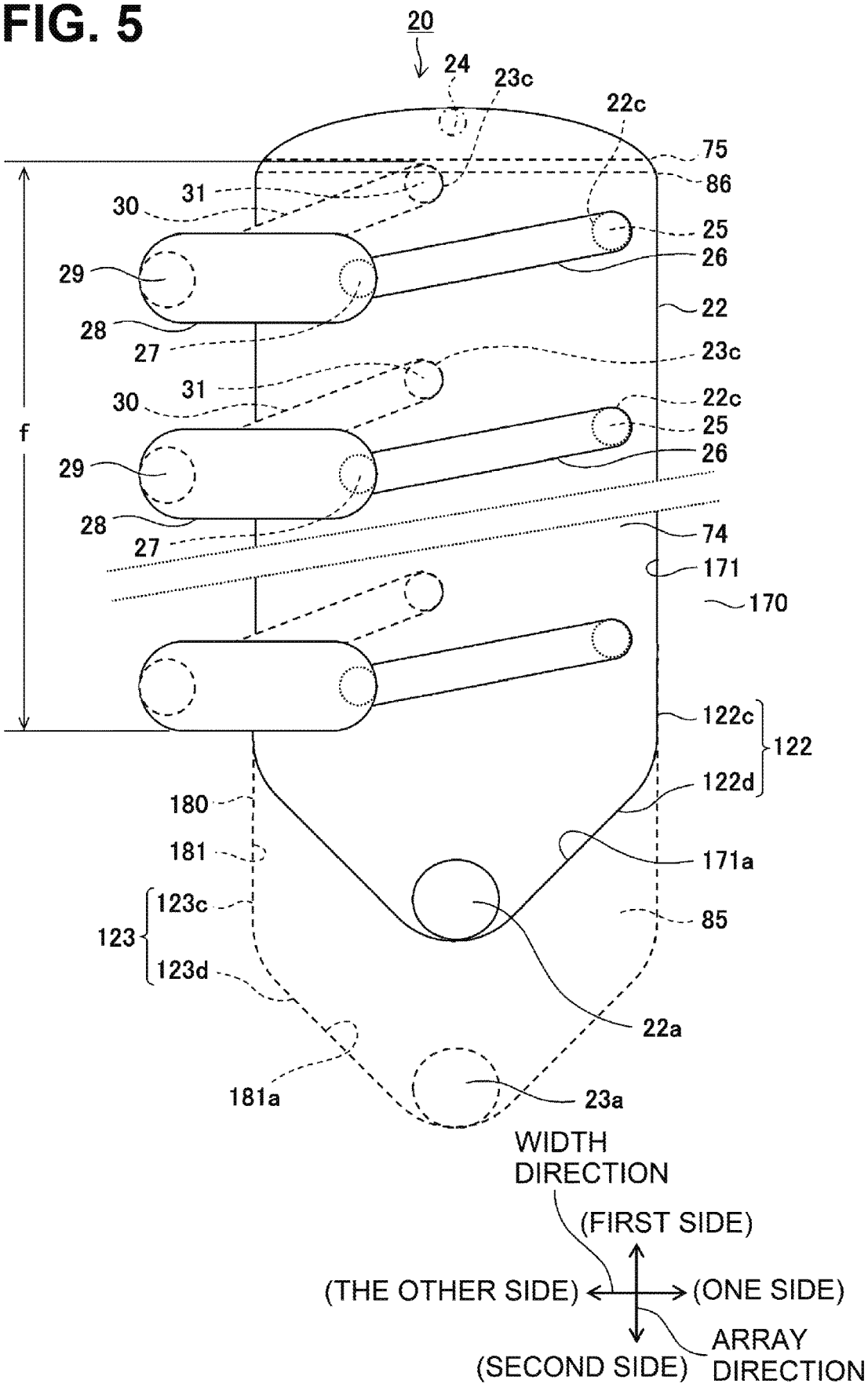
FIG. 5 is a top view of a liquid ejection head in a stacking direction, according to a first modification of the first illustrative embodiment, showing a positional relation of manifolds, throttle channels, communication holes, and pressure chambers.

In a head 20 according to a first modification modified from the first illustrative embodiment, as shown in FIG. 5, a return manifold 123 is tapered toward the return opening 23*a* in the array direction. The return manifold 123 includes a first straight portion 123*c* and a first tapered portion 123*d* in the array direction.

The first straight portion 123*c* extends, in the array direction, in a range f where the individual channels are formed, and has a uniform cross-sectional area in the array direction. The first tapered portion 123*d* is located closer to the return opening 23*a* than the range f, and has a cross-sectional area decreasing toward the return opening 23*a*. In an example shown in FIG. 5, the first tapered portion 123*d* has a dimension in the stacking direction which is uniform and a dimension in the width direction which decreases toward the return opening 23*a*.

A closer portion of the first tapered portion 123*a* to the return opening 23*a* has a smaller cross-sectional area, and a flow velocity increases at the closer portion. Thus, air bubbles are efficiently discharged from the return manifold 23 to the return opening 23*a*.

A first side surface 181 of a first forming unit 180 surrounds the first tapered portion 123*d* and is tapered toward the return opening 23*a*. Air bubbles move along tapered oblique surfaces 181*a*, without being trapped there, to be smoothly discharged to the return opening 23*a*. The return manifold 123 has, on its second side, no recessed corners, thereby promoting discharge of air bubbles without being trapped at any corner.

Second Modification

In a head 20 according to a second modification modified from the first illustrative embodiment, as shown in FIG. 5, a supply manifold 122 is tapered toward the supply opening 22*a*. The supply manifold 122 includes a second straight portion 122*c* and a second tapered portion 122*d* in the array direction.

The second straight portion 122*c* extends, in the array direction, in the range f where the individual channels are formed, and has a uniform cross-sectional area. The second tapered portion 122*d* is located closer to the supply opening 22*a* than the range f, and has a cross-sectional area decreasing toward the supply opening 22*a*. In an example shown in FIG. 5, the second tapered portion 122*d* has a dimension in the stacking direction which is uniform and a dimension in the width direction which decreases toward the supply opening 22*a*.

A farther portion of the second tapered portion 122*d* from the supply opening 22*a*, has a greater cross-sectional area, and a pressure loss of the liquid is smaller at the farther portion. Thus, the liquid entering from the supply opening 22*a* flows smoothly in the supply manifold 22.

A second side surface 171 of a second forming unit 170 surrounds the second tapered portion 122*d* and is tapered toward the supply opening 22*a*. The liquid smoothly flows from the supply opening 22*a* along tapered oblique surfaces 171*a*. The supply manifold 122 has, on its second side, no recessed corners, thereby ensuring a smooth liquid flow in the supply manifold 22 without stagnation at any corner.

In the head 20 in the first modification, the supply manifold 122 may be tapered toward the supply opening 22*a* in the array direction as disclosed in the second modification.

Second Illustrative Embodiment

Figure 6:
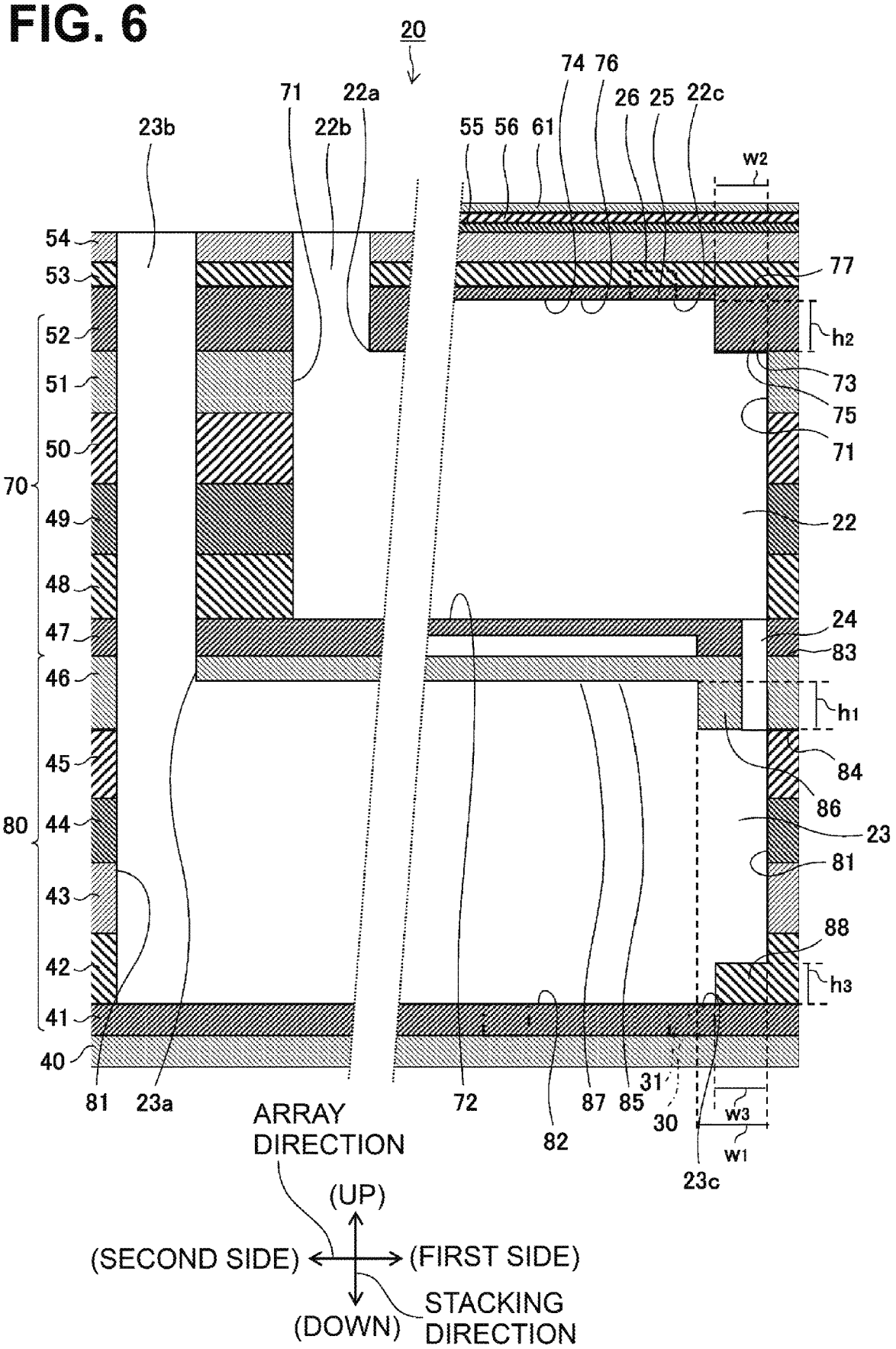
FIG. 6 is a cross-sectional view of a liquid ejection head according to a second illustrative embodiment, taken along a line orthogonal to a width direction of the liquid ejection head.

In a head 20 according to a second illustrative embodiment, as shown in FIG. 6, a first forming unit 80 includes a third protrusion 88 which faces an opening of a bypass channel 24 and protrudes upward from a first bottom surface 82.

A second channel plate 42 includes the third protrusion 88. In this case, the second channel plate 42 includes a pair of surfaces crossing (e.g., orthogonal to) a stacking direction. The second channel plate 42 includes a recess recessed downward from an upper one of the pair of surfaces, and a through-hole formed therethrough in the stacking direction and located further to a second side than the recess. The third protrusion 88 is located below the recess and further to a first side than the through-hole.

The third protrusion 88 is located, in a return manifold, at a corner between a first bottom surface 82 and a first side surface 81 on the first side to face a first protrusion 86 and a lower-end opening of a bypass channel 24. The third protrusion 88 protrudes upward from the first bottom surface 82 by a dimension h3, and protrudes from the first side surface 81 on the first side toward the second side by a dimension w3. The third protrusion 88 extends in a width direction along the entire length of the return manifold 23 in parallel with the first protrusion 86 and a second protrusion 75.

The third protrusion 88 decreases the cross-sectional area of the return manifold 23, thereby increasing the liquid flow velocity. Thus, components of the liquid flowing through the lower-end opening into the return manifold 23 are dispersed and prevented from settling. The liquid flow at a high velocity efficiently pushes away and discharges air bubbles from the return manifold 23.

The third protrusion 88 is located at a lower corner on the first side of the return manifold 23. The third protrusion 88 eliminates any recess at the lower corner which may trap air bubbles, thereby promoting discharge of air bubbles.

Third Modification

Figure 7:
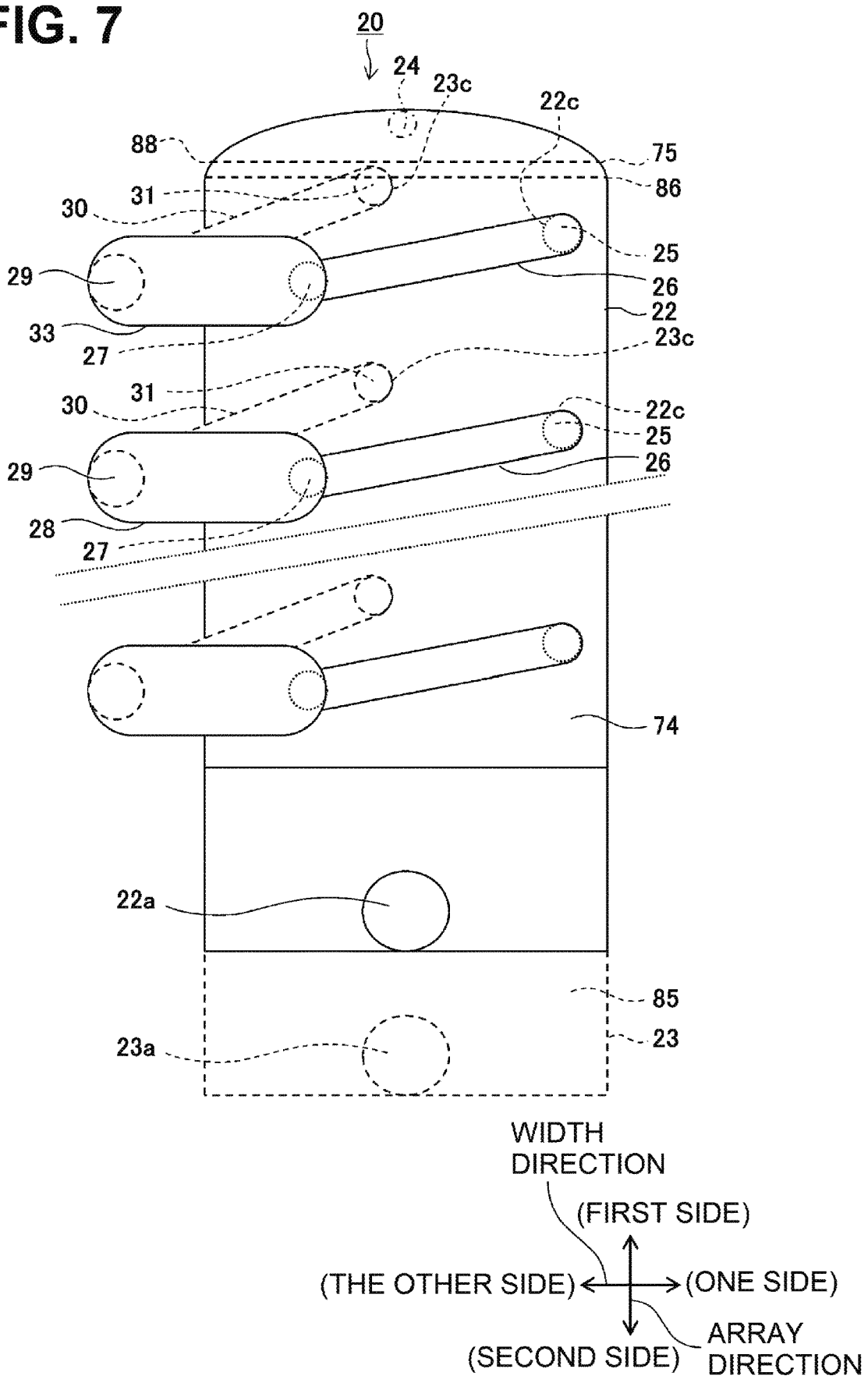
FIG. 7 is a top view of the liquid ejection head of FIG. 6 in a stacking direction, showing a positional relation of manifolds, throttle channels, communication holes, and a dummy chamber.
Figure 8:
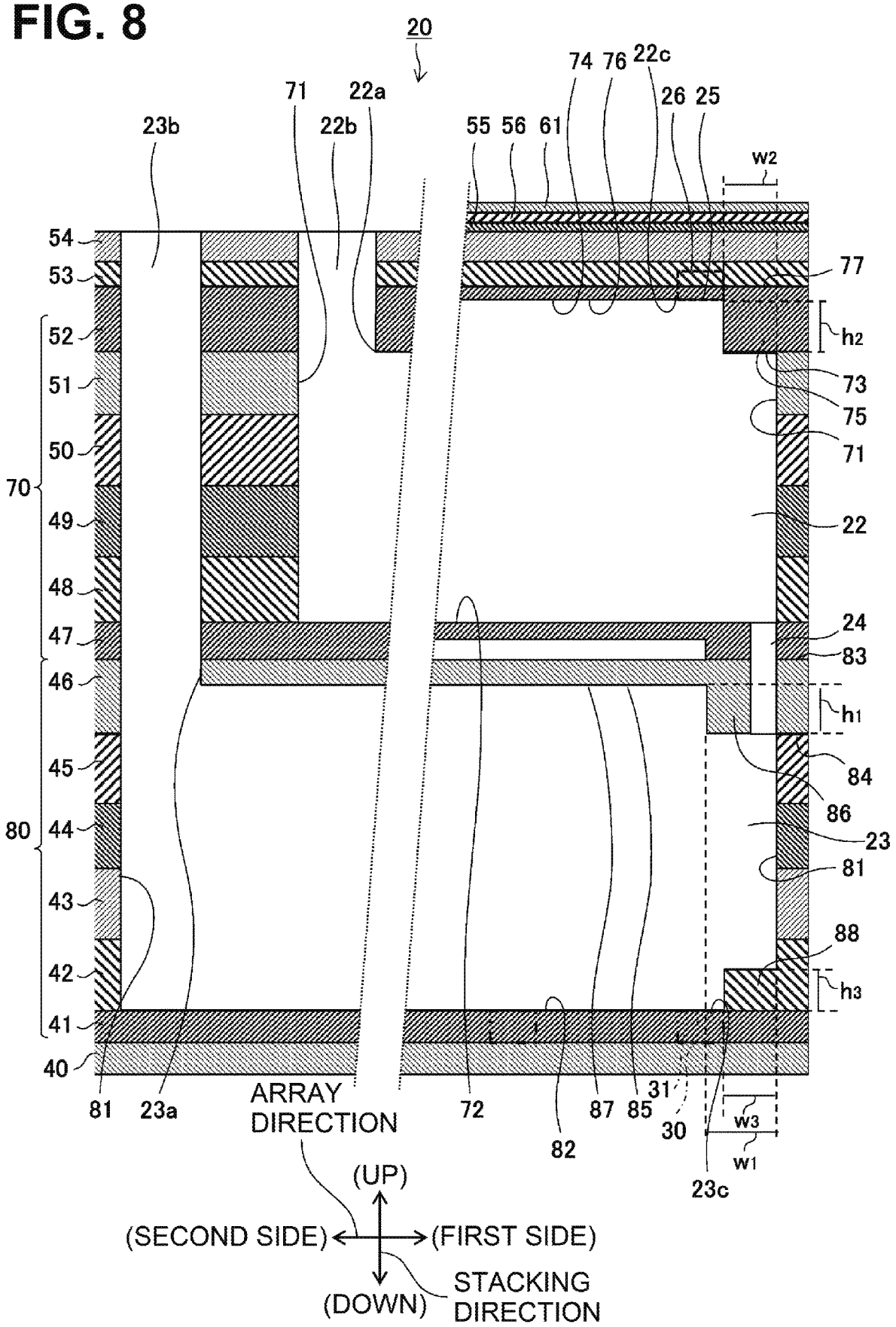
FIG. 8 is a top view of a liquid ejection head in a stacking direction, according to a third modification modified from the second illustrative embodiment, showing a positional relation of manifolds, throttle channels, communication holes, and a pressure chamber.

A head 20 according to a third modification modified from the second illustrative embodiment, as shown in FIGS. 7 and 8, includes a dummy chamber 33 arrayed with the pressure chambers 28 in the array direction. The return manifold 23 includes a first opening 23*c* communicating with the dummy chamber 33. The supply manifold 22 includes a second opening 22*c* communicating with the dummy chamber 33. The second protrusion 75 is located closer to the bypass channel 24 than the second opening 22*c* in the array direction. The third protrusion 88 is located closer to the bypass channel 24 than the first opening 23*c* in the array direction.

Specifically, the individual channels include pressure chamber channels and a dummy channel. Each pressure chamber channel includes a first communication hole 25, a supply throttle channel 26, a second communication hole 27, a pressure chamber 28, a descender 29, a return throttle channel 30, and a third communication hole 31, which are fluidly connected in this order. The dummy channel is similar to each pressure chamber channel except that the dummy channel includes a dummy chamber 33 instead of a pressure chamber 28. The dummy channel includes a first communication hole 25, a supply throttle channel 26, a second communication hole 27, a dummy chamber 33, a descender 29, a return throttle channel 30, and a third communication hole 31, which are fluidly connected in this order.

The dummy chamber 33 is fluidly connected to the supply manifold 22 via the second communication hole 27, the supply throttle channel 26, and the first communication hole 25. The supply manifold 22 is fluidly connected, at the second opening 22*c*, to the first communication hole 25.

The dummy chamber 33 is fluidly connected to the return manifold 23 via the descender 29, the return throttle channel 30, and the third communication hole 31. The return manifold 23 is fluidly connected, at the first opening 23*c*, to the third communication hole 31.

The dummy chamber 33 ejects no liquid from a corresponding nozzle 21. Therefore, the dummy chamber 33 may not communicate with a nozzle 21. No drive signal may be applied to a piezoelectric element 60 stacked on the dummy channel 33. Alternatively, no piezoelectric element 60 may be provided for the dummy channel 33.

The dummy chamber 33 is located at a first-side end in the array direction. The first communication hole 25 communicating with the dummy chamber 33 is located adjacent to a second side of the second protrusion 75 in the array direction. The second protrusion 75 is located between the first communication hole 25 and the second side surface 71 on the first side. The second protrusion 75 has a dimension w2 between the first communication hole 25 and the second side surface 71 on the first side.

The second protrusion 75 extends long so as not to cover the first communication hole 25. Liquid is allowed to flow from the supply manifold 22, via the first communication hole 25, into the dummy chamber 33. The second protrusion 75 increases the flow velocity of the liquid flowing into the bypass channel 24. The second protrusion 75 traps air bubbles at a portion closer to the first communication hole 25, and the air bubbles are pushed away from the first communication hole 25, via the dummy chamber 33, to the return manifold 23.

The third communication hole 31 communicating with the dummy chamber 33 is located adjacent to a second side of the third protrusion 88 in the array direction. The third protrusion 88 is located between the third communication hole 31 and the first side surface 81 on the first side. The third protrusion 88 has a dimension w3 between the third communication hole 31 and the first side surface 81 on the first side.

The third protrusion 88 extends long so as not to cover the third communication hole 31. Liquid is allowed to flow from the dummy chamber 33, via the third communication hole 31, into the return manifold 23. The third protrusion 88 increases the flow velocity of the liquid which discharges air bubbles from the return manifold 23.

The liquid not having flown into the individual channels flows from the supply manifold 22, via the dummy channel and the bypass channel 23, into the return manifold 23. This increases the amount of liquid to be circulated, thereby preventing settling of liquid components and promoting discharge of air bubbles.

In the array direction, the dimension w3 of the third protrusion 88 may be less than the dimension w1 of the first protrusion 86. This enables to reduce a distance between the third communication hole 31 and the first side surface 81 on the first side, thereby making the head 20 compact in the array direction.

In the array direction, the dimension w3 of the third protrusion 88 may be equal to the dimension w2 of the second protrusion 75. For example, as shown in FIG. 8, the first communication hole 25 and the third communication hole 31 are located to overlap in the stacking direction. In this case, a distance between the third communication hole 31 and the first side surface 81 on the first side is equal to a distance between the first communication hole 25 and the second side surface 71 on the first side.

The second protrusion 75 is located between the first communication hole 25 and the second side surface 71 on the first side, and the second protrusion 88 is located between the third communication hole 31 and the first side surface 81 on the first side. This allows the second protrusion 75 and the third protrusion 88 to extend long without covering the first communication hole 25 and the second communication hole 27, respectively.

The head 20 in the first and second modifications may include a third protrusion 88 as disclosed in the second illustrative embodiment. The head 20 in the first illustrative embodiment and in the first and second modifications may include a dummy chamber 33 as disclosed in the third modification.

In all the above-described illustrative embodiments and modifications, the supply manifold 22 and the return manifold 23 overlap each other in the stacking direction. However, the supply manifold 22 and the return manifold 23 may be located adjacent to each other in a direction orthogonal to the stacking direction. In this case also, the first protrusion 86 may reduce settling of liquid components.

While the disclosure has been described with reference to the specific embodiments thereof, these are merely examples, and various changes, arrangements and modifications may be applied therein without departing from the spirit and scope of the disclosure.

What is claimed is:

1. A liquid ejection head comprising:

a plurality of pressure chambers arrayed in an array direction and each configured to receive an ejection pressure for ejecting liquid from a corresponding nozzle;

a supply manifold extending in the array direction and communicating with the pressure chambers, the supply manifold including a supply opening through which liquid enters from an exterior;

a return manifold disposed below the supply manifold and formed by a first forming unit to extend in the array direction and communicate with the pressure chambers, the return manifold including a return opening through which liquid exits to the exterior; and a bypass channel connecting the supply manifold and the return manifold, wherein the first forming unit includes:

a first top surface defining a top surface of the return manifold; and a top surface plate including:

an upper surface;

a lower surface opposite to the upper surface;

a recess recessed upward from the lower surface to the first top surface; and a first protrusion protruding downward from the first top surface and having a lower end at which the bypass channel is open, the first protrusion formed by a step between the lower surface and the first top surface.

2. The liquid ejection head according to claim 1, wherein the bypass channel penetrates a portion of the top surface plate, the portion being between the upper surface and the lower surface.

3. The liquid ejection head according to claim 1, wherein the recess extends between the first protrusion and the return opening.

4. A liquid ejection head comprising:

a plurality of pressure chambers arrayed in an array direction and each configured to receive an ejection pressure for ejecting liquid from a corresponding nozzle;

a supply manifold extending in the array direction and communicating with the pressure chambers, the supply manifold including a supply opening through which liquid enters from an exterior;

a return manifold disposed below the supply manifold and formed by a first forming unit to extend in the array direction and communicate with the pressure chambers, the return manifold including a return opening through which liquid exits to the exterior; and a bypass channel connecting the supply manifold and the return manifold, wherein the first forming unit includes:

a first top surface defining a top surface of the return manifold; and a first protrusion protruding downward from the first top surface and having a lower end at which the bypass channel is open, wherein the supply manifold is formed by a second forming unit including:

a second bottom surface which defines a bottom surface of the supply manifold and on which the bypass channel is open;

a second top surface facing the second bottom surface; and a second protrusion facing an opening of the bypass channel and protruding downward from the second top surface, and wherein a protruding dimension of the first protrusion is less than a protruding dimension of the second protrusion.

5. A liquid ejection head comprising:

a plurality of pressure chambers arrayed in an array direction and each configured to receive an ejection pressure for ejecting liquid from a corresponding nozzle;

a supply manifold extending in the array direction and communicating with the pressure chambers, the supply manifold including a supply opening through which liquid enters from an exterior;

a return manifold disposed below the supply manifold and formed by a first forming unit to extend in the array direction and communicate with the pressure chambers, the return manifold including a return opening through which liquid exits to the exterior; and a bypass channel connecting the supply manifold and the return manifold, wherein the first forming unit includes:

a first top surface defining a top surface of the return manifold; and a first protrusion protruding downward from the first top surface and having a lower end at which the bypass channel is open, wherein the supply manifold is formed by a second forming unit including:

a second bottom surface which defines a bottom surface of the supply manifold and on which the bypass channel is open;

a second top surface facing the second bottom surface; and a second protrusion facing an opening of the bypass channel and protruding downward from the second top surface, and wherein the second forming unit includes a second top surface plate including:

a second upper surface;

a second lower surface opposite to the second upper surface;

a second recess recessed upward from the second lower surface to the second top surface; and a second protrusion formed by a step between the second lower surface and the second top surface.

6. A liquid ejection head comprising:

a plurality of pressure chambers arrayed in an array direction and each configured to receive an ejection pressure for ejecting liquid from a corresponding nozzle;

a supply manifold extending in the array direction and communicating with the pressure chambers, the supply manifold including a supply opening through which liquid enters from an exterior;

a return manifold disposed below the supply manifold and formed by a first forming unit to extend in the array direction and communicate with the pressure chambers, the return manifold including a return opening through which liquid exits to the exterior; and a bypass channel connecting the supply manifold and the return manifold, wherein the first forming unit includes:

a first top surface defining a top surface of the return manifold;

a first protrusion protruding downward from the first top surface and having a lower end at which the bypass channel is open;

a first bottom surface which faces the first top surface and on which the bypass channel is open; and a third protrusion facing an opening of the bypass channel and protruding upward from the first bottom surface, wherein the supply manifold is formed by a second forming unit including:

a second bottom surface which defines a bottom surface of the supply manifold and on which the bypass channel is open;

a second top surface facing the second bottom surface; and a second protrusion facing an opening of the bypass channel and protruding downward from the second top surface.

7. The liquid ejection head according to claim 6, further comprising a dummy chamber arrayed with the pressure chambers in the array direction, wherein the return manifold includes a first opening communicating with the dummy chamber, the supply manifold includes a second opening communicating with the dummy chamber, the second protrusion is closer to the bypass channel in the array direction than the second opening, and the third protrusion is closer to the bypass channel in the array direction than the first opening.

8. A liquid ejection head comprising:

a plurality of pressure chambers arrayed in an array direction and each configured to receive an ejection pressure for ejecting liquid from a corresponding nozzle;

a supply manifold extending in the array direction and communicating with the pressure chambers, the supply manifold including a supply opening through which liquid enters from an exterior;

a return manifold disposed below the supply manifold and formed by a forming unit to extend in the array direction and communicate with the pressure chambers, the return manifold including a return opening through which liquid exits to the exterior; and a bypass channel connecting the supply manifold and the return manifold, wherein the forming unit includes:

a first top surface defining a top surface of the return manifold; and a protrusion protruding downward from the first top surface and having a lower end at which the bypass channel is open, and wherein the return manifold is tapered toward the return opening.

9. A liquid ejection head comprising:

a plurality of pressure chambers arrayed in an array direction and each configured to receive an ejection pressure for ejecting liquid from a corresponding nozzle;

a supply manifold extending in the array direction and communicating with the pressure chambers, the supply manifold including a supply opening through which liquid enters from an exterior;

a return manifold disposed below the supply manifold and formed by a forming unit to extend in the array direction and communicate with the pressure chambers, the return manifold including a return opening through which liquid exits to the exterior; and a bypass channel connecting the supply manifold and the return manifold, wherein the forming unit includes:

a first top surface defining a top surface of the return manifold; and a protrusion protruding downward from the first top surface and having a lower end at which the bypass channel is open, and wherein the supply manifold is tapered toward the supply opening.

10. The liquid ejection head according to claim 1, wherein the array direction is an elongated direction of the supply manifold and the return manifold, and wherein the bypass channel is disposed opposite to the supply opening and the return opening with respect to the plurality of pressure chambers in the array direction.

11. The liquid ejection head according to claim 10, wherein the bypass channel penetrates a portion of the top surface plate, the portion being between the upper surface and the lower surface.

12. The liquid ejection head according to claim 10, wherein the recess extends between the first protrusion and the return opening.

13. The liquid ejection head according to claim 10, wherein the first forming unit further includes a bottom surface facing the first top surface, and wherein the liquid ejection head further comprises a throttle channel communicating with a corresponding one of the pressure chambers and the return manifold, the throttle channel being open on the bottom surface and having a cross-sectional area smaller than a cross-sectional area of the corresponding one of the pressure chambers.

14. The liquid ejection head according to claim 10, wherein the supply manifold is formed by a second forming unit including:

a second bottom surface which defines a bottom surface of the supply manifold and on which the bypass channel is open;

a second top surface facing the second bottom surface; and a second protrusion facing an opening of the bypass channel and protruding downward from the second top surface.

15. The liquid ejection head according to claim 14, wherein a protruding dimension of the first protrusion is less than a protruding dimension of the second protrusion.

16. The liquid ejection head according to claim 14, wherein a dimension of the first protrusion in the array direction is greater than a dimension of the second protrusion in the array direction.

17. The liquid ejection head according to claim 14, wherein the second forming unit includes a top surface plate including:

an upper surface;

a lower surface opposite to the upper surface;

a recess recessed upward from the lower surface to the second top surface; and the second protrusion formed by a step between the lower surface and the second top surface.

18. The liquid ejection head according to claim 14, wherein the first forming unit includes:

a bottom surface which faces the first top surface and on which the bypass channel is open, and a third protrusion facing an opening of the bypass channel and protruding upward from the bottom surface.

19. The liquid ejection head according to claim 18, further comprising a dummy chamber arrayed with the pressure chambers in the array direction, wherein the return manifold includes a first opening communicating with the dummy chamber, the supply manifold includes a second opening communicating with the dummy chamber, the second protrusion is closer to the bypass channel in the array direction than the second opening, and the third protrusion is closer to the bypass channel in the array direction than the first opening.

20. The liquid ejection head according to claim 10, wherein the return manifold is tapered toward the return opening.

21. The liquid ejection head according to claim 10, wherein the supply manifold is tapered toward the supply opening.

22. The liquid ejection head according to claim 1, wherein the bypass channel is connected, at its upper end, to the supply manifold and, at its lower end, to the return manifold.

23. The liquid ejection head according to claim 1, wherein the bypass channel directly connects the supply manifold and the return manifold.

24. The liquid ejection head according to claim 1, wherein the bypass channel connects, without going through the plurality of pressure chambers, the supply manifold and the return manifold.

* * * * *